US005993509A

United States Patent [19]

Tsao et al.

[11] Patent Number: 5,993,509

[45] Date of Patent: Nov. 30, 1999

[54] ATOMIZING APPARATUS AND PROCESS

[76] Inventors: Chi-Yuan Albert Tsao, No. 27, Fa-Hauh St., Tana; Yain-Hauw Su, No. 3, Lane 84, An-Chung Rd., Shin-Tien, Taipei Hsien; Yain-Ming Chen, No. 16, Lane 226, West Sec., Tsu-yu Rd., Pingtung; Ray-Wen Lin, No. 319, Der-Hauh St., Taichung, all of Taiwan

[21] Appl. No.: 08/751,970

[22] Filed: Nov. 19, 1996

[51] Int. Cl.[6] ..... B22F 9/08

[52] U.S. Cl. ..... 75/337; 75/338; 75/339

[58] Field of Search ..... 75/337, 338, 339, 75/355

[56] References Cited

U.S. PATENT DOCUMENTS

| | | | |
|---|---|---|---|
| 4,382,903 | 5/1983 | Larsson et al. | 75/338 |
| 4,779,802 | 10/1988 | Coombs | 164/46 |
| 4,780,130 | 10/1988 | Raman et al. | 75/338 |
| 4,905,899 | 3/1990 | Coombs et al. | 164/46 |

FOREIGN PATENT DOCUMENTS

| | | | |
|---|---|---|---|
| 57-47805 | 3/1982 | Japan | 75/337 |
| 4-66609 | 3/1992 | Japan | 75/337 |
| 4-99105 | 3/1992 | Japan | 75/337 |
| 89/12116 | 12/1989 | WIPO | 75/338 |

*Primary Examiner*—George Wyszomierski

[57] ABSTRACT

This invention relates to a method and apparatus for atomizing a liquid stream of metal or metal alloy. This invention relates to producing powders as well as to spray deposition process. During atomizing, a backpressure is created below the exit of the liquid delivery nozzle by the impingement of the atomization gas jets around the atomization zone. And this may block further atomization. The present invention provides a method of atomizing and an atomizing apparatus to control the backpressure. During atomizing, the intensities and directions of the atomization gas jets affects the atomization characteristics. The present invention provides a method of atomizing and an atomizing apparatus to control both the intensities and directions of the atomization gas jets.

7 Claims, 18 Drawing Sheets

(h) A043

Pu = 0.04 MPa

Pu = 0.06 MPa

Pu = 0.08 MPa

Pu = 0.10 MPa

Pu = 0.14 MPa

Pu = 0.20 MPa

Pu = 0.40 MPa

ATOMIZING APPARATUS AND PROCESS

FIELD OF THE INVENTION

This invention relates to a method and apparatus for atomizing a liquid stream of metal or metal alloy. This invention relates to producing powders as well as to spray deposition process.

BACKGROUND OF THE INVENTION

For both powder production and spray deposition process, there are traditionally two kinds of atomization devices for atomizing a liquid stream of metal or metal alloys coming out of the liquid delivery nozzle into a spray of droplets. One is the "Free Fall" type of design, in which the stream of metal or metal alloy is atomized at a certain distance away from the exit of the liquid delivery nozzle. The other design is the "Confined" type of design, in which the stream of metal or metal alloy is atomized at the exit of the liquid delivery nozzle. The Confined type of atomization device gives more efficient and uniform transfer of energy from atomization gas to the stream of metal or metal alloy, due to the shorter distance between the atomization gas and the stream of metal or metal alloy and prefilming of the molten metal or metal alloy over the end of the liquid delivery nozzle. However, since the impingement point of the atomization gas is close to the exit of the liquid delivery nozzle, the molten metal or metal alloy is easier to freeze-up inside the liquid delivery nozzle, which blocks further atomization. The Free-Fall type atomization device doesn't have the freeze-up problem; however, the atomization efficiency is reduced compared to the Confined type of atomization device, resulting in coarser atomized powder and coarser microstructures due to a lower cooling rate.

During atomizing, a backpressure is created by the impingement of the atomization gas jets around the atomization zone below the exit of the liquid deliver nozzle. The backpressure has two effects. One effect is generating backsplash during atomization, in which molten metal or metal alloy is backsplashed upwards away from the atomization zone. The backsplashed molten metal or metal alloy may either deposit back onto the atomization device and block further atomization, or become coarse and irregular shaped powders, which may not be desired. Another effect is influencing the atomization rate, or the flow rate of the metal or metal alloy stream coming out of the liquid delivery nozzle. In the extreme, a complete blockage of the metal or metal alloy stream from coming out of the liquid delivery nozzle is likely to happen due to the backpressure. The present invention provides a method of atomizing and an atomizing apparatus to control the backpressure.

During atomizing, the intensities and directions of the atomization gas jets affect the atomization characteristics, such as atomization efficiency, atomization rate, the cooling rate of atomized droplets, trajectories and velocities of atomized droplets, shapes and sizes of atomized droplets, the spatial flux distribution of atomized droplets, etc. The intensities of the atomization gas jets are manipulated through controlling the pressure and/or flow rate of the atomization gas. However, the directions of the atomization gas jets are fixed by the design of the atomization device. In U.S. Pat. No. 4,779,802, and U.S. Pat. No. 4,905,899, the atomization device is scanned to control the directions of the atomization gas jets. The present invention provides a method of atomizing and an atomizing apparatus to control both the intensities and directions of the atomization gas jets.

SUMMARY OF THE INVENTION

One aspect of the present invention is to control the created backpressure, which, in turn, controls the backsplash and the atomization rate, or the flow rate of the metal or metal alloy stream coming out of the liquid delivery nozzle. Another aspect of the present invention is to control the atomization characteristics by controlling the intensities and directions of the atomization gas jets, which, in turn, controls the droplet characteristics, such as the variations of size, shape, temperature, heat content and microstructure of droplets, etc., and/or powder characteristics, such as powder size distribution, the powder shape distribution, the microstructure variations of powders, etc., and/or spray-deposit characteristics, such as the morphology, macrostructures and microstructures of the deposit, etc.

DESCRIPTION OF THE INVENTION

According to one aspect of the present invention there is provided a method of atomizing a liquid stream of metal or metal alloy consisting of the steps of:

teeming a stream of molten metal or metal alloy into an atomization device, atomizing the stream with atomization gas to form droplets of metal or metal alloy, and directing controlling fluid at atomization gas jets or at an atomization zone to control the backpressure and, if desired, the intensities and directions of the atomization gas jets. Preferably the atomization gas issues from first jets, and the controlling fluid issues from second jets directed at the atomization gas jets or at the atomization zone. The intensity, flow rate and pressure of the secondary jets are preset to control or are in-situ adjusted to in-situ control the backpressure and/or the intensities and directions of the atomization gas jets. The method may be for the production of powder to control the powder characteristics. Alternatively, the method may be for the production of spray deposits to control the deposit characteristics. Alternatively, the secondary jets may be so arranged, through which solid particles or whiskers of the same or different composition (either metallic or non-metallic) of the metal to be atomized are introduced into the controlling fluid which acts as a transport vehicle for the particles or whiskers to be co-deposited with the atomized droplets to form spray-deposited composite materials. Alternatively, the particles or whiskers are introduced from above the secondary jets, which also gives a mixture of the particles or whiskers with the spray to form spray-deposited composite materials. Suitably, the controlling fluid is an inert gas, such as Argon, Helium and Nitrogen, or Air. Alternatively, the controlling fluid may be cryogenic liquified gas which changes to a gaseous phase upon heating by the metal or metal alloy stream. The atomization gas is suitably an inert gas, such as Argon, Helium and Nitrogen, or air. The selection of gases is made in accordance with the compatibility with the liquid metal or metal alloy to be atomized.

According to another aspect of the invention there is provided an atomizing apparatus consisting of an atomization device for receiving a stream of molten metal or metal alloy to be atomized, means for directing atomization gas at the liquid stream to atomize the stream, and means for directing controlling fluid at atomization gas jets or at an atomization zone to control the backpressure and/or the atomization characteristics. In the preferred arrangement, the means for directing the atomization gas consists of primary jets and the means for directing the controlling fluid consists of secondary jets directed at the atomization gas jets or at the atomization zone. The intensity, flow rate and pressure of the secondary jets are preset to control or are in-situ adjusted to in-situ control the backpressure and/or the intensities and directions of the atomization gas jets. Suitably, the controlling fluid is an inert gas, such as Argon, Helium and Nitrogen, or air. Alternatively, the controlling fluid may be cryogenic liquified gas which changes to a gaseous phase upon heating by the metal or metal alloy stream. The atomization gas is suitably an inert gas, such as Argon, Helium and Nitrogen, or air. The selection of gases is made in accordance with the compatibility with the liquid metal or metal alloy to be atomized.

Alternatively, the apparatus may be used to produce spray deposits on a suitable collector.

BRIEF DESCRIPTION OF THE DRAWINGS

The invention will now be described by way of example with reference to the accompanying in which.

(a) A035 sample
(b) A036 sample
(c) A037 sample
(d) A038 sample
(e) A039 sample
(f) A040 sample
(g) A042 sample
(h) A043 sample
(i) A044 sample

Figure 1:
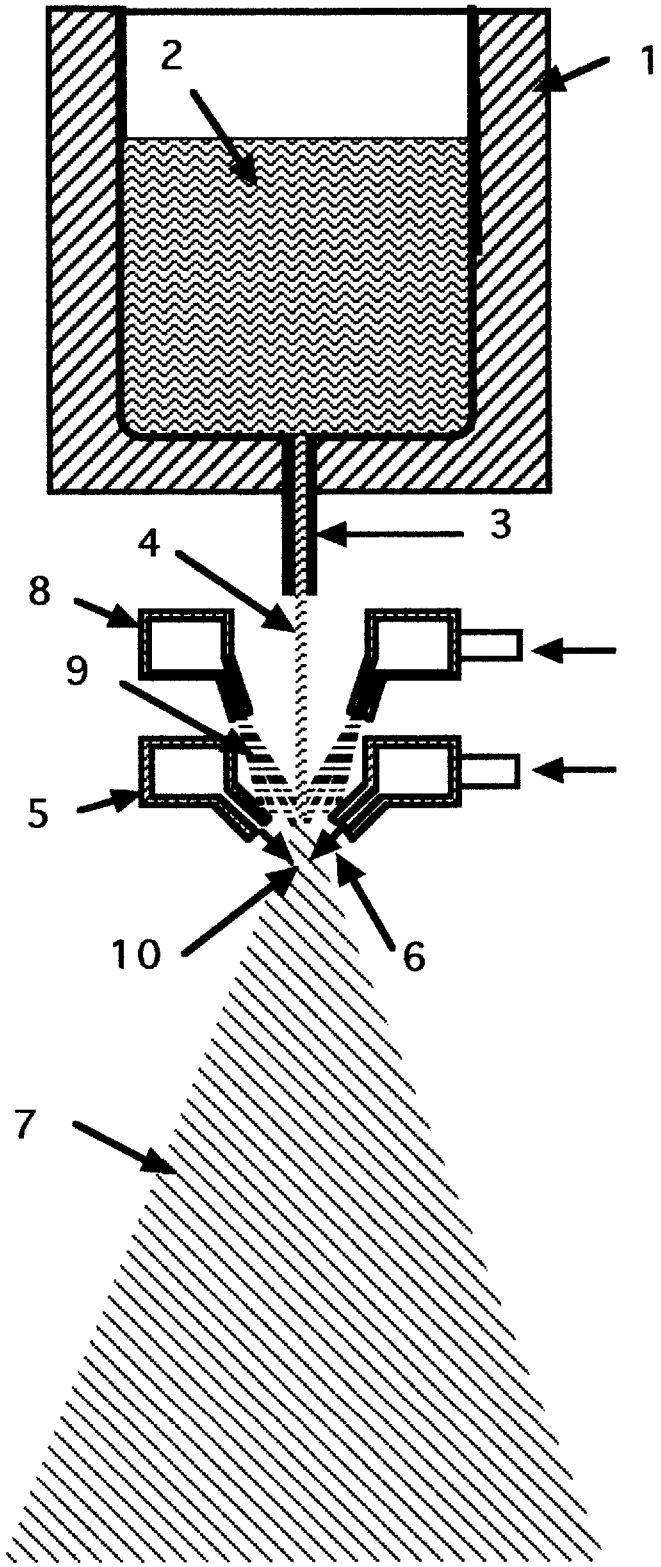
FIG. 1 is a schematic sectional side elevation of a gas atomizing apparatus according to the invention.

(a) Pu=0.04 MPa
(b) Pu=0.06 MPa
(c) Pu=0.08 MPa
(d) Pu=0.10 MPa
(e) Pu=0.14 MPa
(f) Pu=0.20 MPa
(g) Pu=0.40 MPa

Table 1 lists the process parameters used for the production of powders with the application of controlling fluid technique;

Table 2 lists the first and second peak values of the distribution of powder sizes produced with the application of controlling fluid technique.

Table 3 lists the process parameters used to spray deposit Pb-50% Sn alloy preforms employing controlling fluid technique.

Reference Number Of Elements In The Drawings

1 . . . crucible or tundish
2 . . . liquid metal or metal alloy
3 . . . liquid delivery nozzle
4 . . . liquid metal or metal alloy stream
5 . . . primary gas atomization device
6 . . . primary atomization gas jets
7 . . . a spray of atomized droplets
8 . . . a secondary controlling fluid jets device
9 . . . controlling fluid jets
10 . . . atomization zone
11 . . . crucible/tundish metal dispensing system
12 . . . with liquid metal
13 . . . the gas atomization device
14 . . . the secondary controlling fluid jets device . . .
15 . . . inlet pipe
16 . . . separate inlet pipe
17 . . . a spray chamber
18 . . . a powder collection vessel
19 . . . a gas exhaust pipe
20 . . . a current to pneumatic pressure(P/I) converter
21 . . . controlling fluid control valve

DETAILED DESCRIPTION OF THE PREFERRED EMBODIMENTS

In FIG. 1, an atomizing apparatus for gas atomizing liquid metal or alloy is shown consisting of a refractory or refractory lined crucible or tundish (1) for containing liquid metal or metal alloy (2). The crucible (1) has a liquid delivery nozzle (3) to provide a liquid metal or metal alloy stream (4) of a desired diameter. The liquid metal or metal alloy stream (4) teems into a central opening in a primary gas atomization device (5) which causes a number of atomization gas jets (6) to be directed at the liquid metal or metal alloy stream (4) so as to atomize the stream into a spray of atomized droplets (7). The primary atomization gas jets (6) preferably spray Nitrogen, Argon or Helium, but air may also be used. The atomizing assembly also consists of a secondary controlling fluid jets device (8), disposed upstream of the primary atomization gas jets (6), containing a number of controlling fluid jets (9) which apply Nitrogen, Argon, Helium, air, or cryogenic liquified gas jets to the atomization gas jets (6) or to the atomization zone (10). The pressure and flow rate of the controlling fluid applied at the secondary controlling fluid jets device (8) is controlled to manipulate the back-pressure and the atomization characteristics. The controlling can be made in-situ during atomizing.

Figure 2:
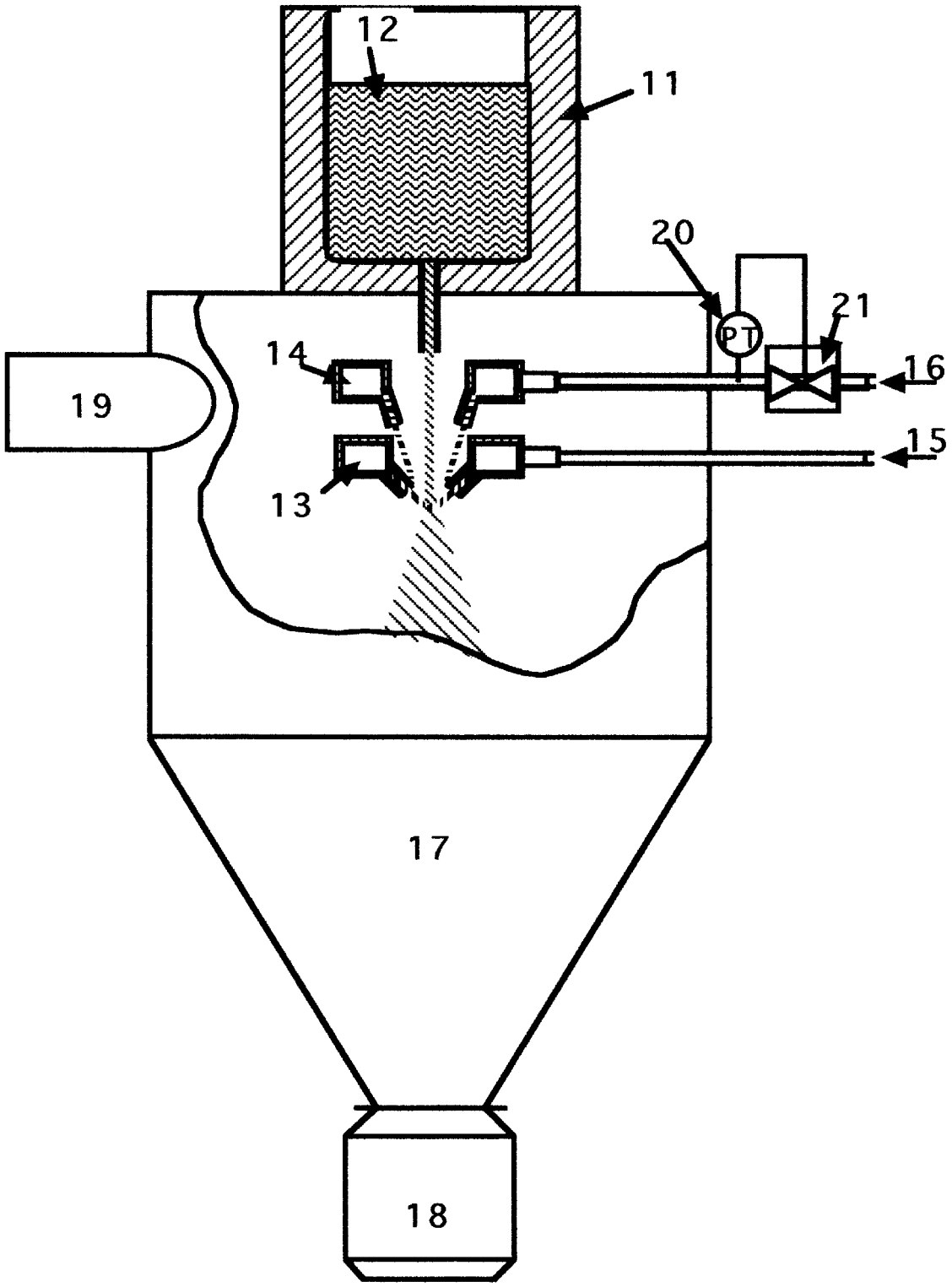
FIG. 2 is a schematic side elevation of apparatus for producing powders including the atomizing apparatus according to the invention together with an alternative base arrangement.

FIG. 2 shows the apparatus of FIG. 1 as applied to a powder production apparatus. In this figure, the crucible/tundish metal dispensing system (11) containing liquid metal (12), the gas atomization device (13) and the controlling fluid jets device (14) are positioned on a spray chamber (17). Atomization gas is supplied to the gas atomization device (13) via an inlet pipe (15), and controlling fluid is supplied to the controlling fluid jets device (14) via a separate inlet pipe (16). At the base of the spray chamber is a powder collection vessel (18), the chamber additionally containing a gas exhaust pipe (19). The flow rate of the controlling fluid applied at the secondary controlling fluid jets device (14) is controlled by activating the controlling fluid control valve (21) via a current to pneumatic pressure (P/I) converter (20). The controlling can be made in-situ during atomizing.

During atomizing, the backpressure is controlled by the controlling fluid jets device, which controls the extent of the backsplash and the atomization rate, or the flow rate of the metal or metal alloy stream coming out of the liquid delivery nozzle. In addition, the intensities and directions of the atomization gas jets are controlled by the controlling fluid jets device, which controls the atomization characteristics. Consequently, the droplet characteristics, such as the variations of size, shape, temperature, heat content and microstructure of droplets, etc., and powder characteristics, such as powder size distribution, the powder shape distribution, the microstructure variations of powders, etc., are controlled. The pressure and/or flow rate of the controlling fluid are in-situ adjustable during atomizing to in-situ control the backpressure and/or the intensities and directions of the atomization gas jets.

EXAMPLE OF THE USE OF NITROGEN GAS AS THE CONTROLLING FLUID IN THE ATOMIZATION OF WATER

The example below illustrates the principles of selecting the process parameters by illustrating the conditions used for the atomization of water employing the controlling fluid technique. Pu is the nitrogen gas pressure used for the controlling fluid jets device, $p_1$ is the nitrogen gas pressure used for the gas atomization device, and R is the vertical distance between the controlling fluid jets device and gas atomization device.

The principles of selection of R is discussed below for this example. When R>25 mm, the controlling fluid jets device was too far from the gas atomization device, so that when the controlling fluid became large enough to surpress the backpressure, the water was atomized by the controlling fluid also, which rendered the controlling fluid jets device meaningless. When R<5 mm. As a result, the R needed to be limited between 5 mm and 25 mm in this example.

Figure 3:
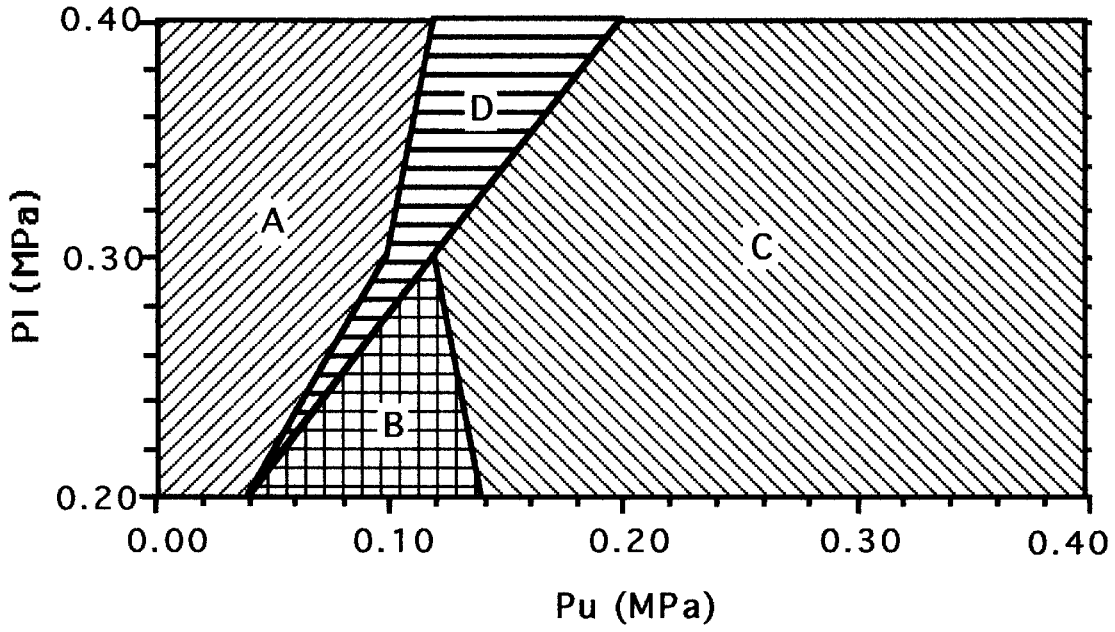
FIG. 3 is a Process Map of Pu vs. PI for R=15 mm for water atomization
Figure 4:
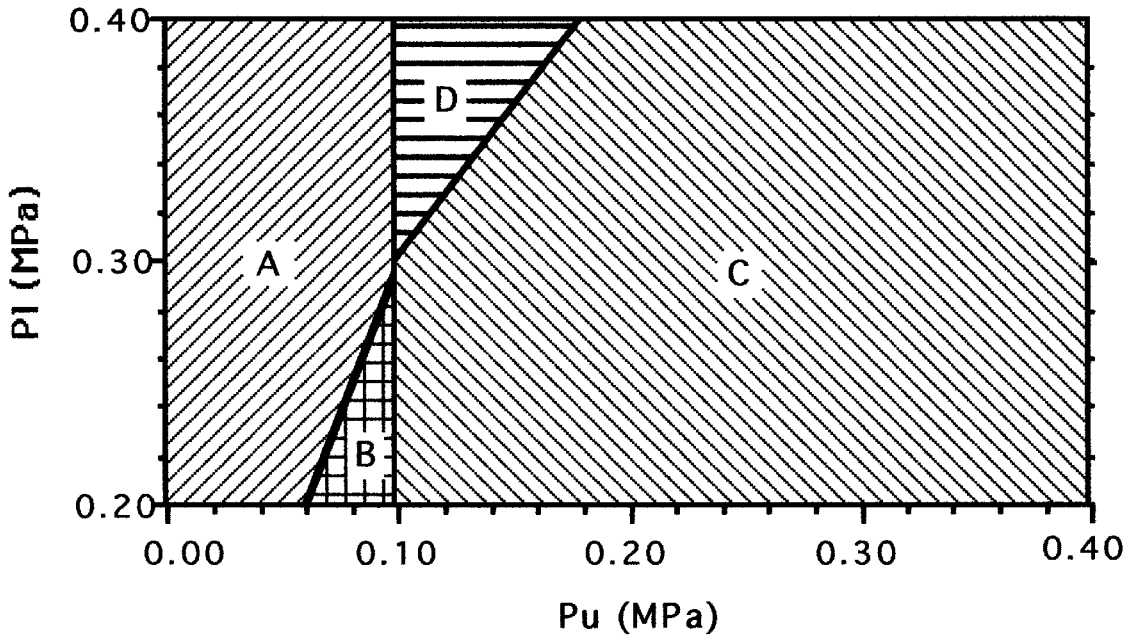
FIG. 4 is a Process Map of Pu vs. $p_1$ for R=20 mm for water atomization
Figure 5:
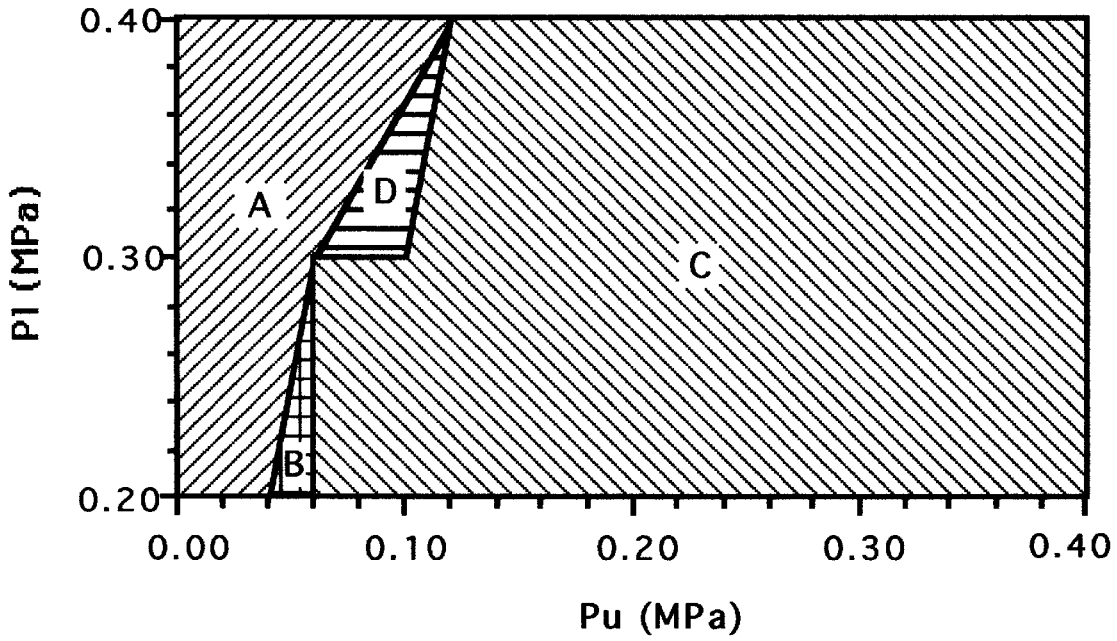
FIG. 5 is a Process Map of Pu vs. $p_1$ for R=25 mm for water atomization
Figure 6:
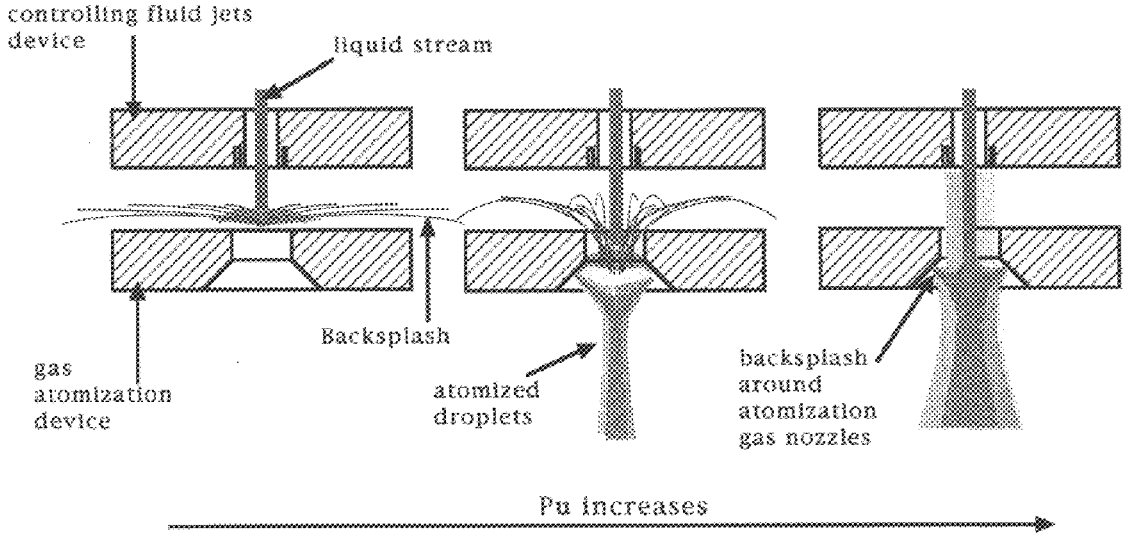
FIG. 6 shows the atomization phenomena for region A in the Process Map of Pu vs. $p_1$
Figure 7:
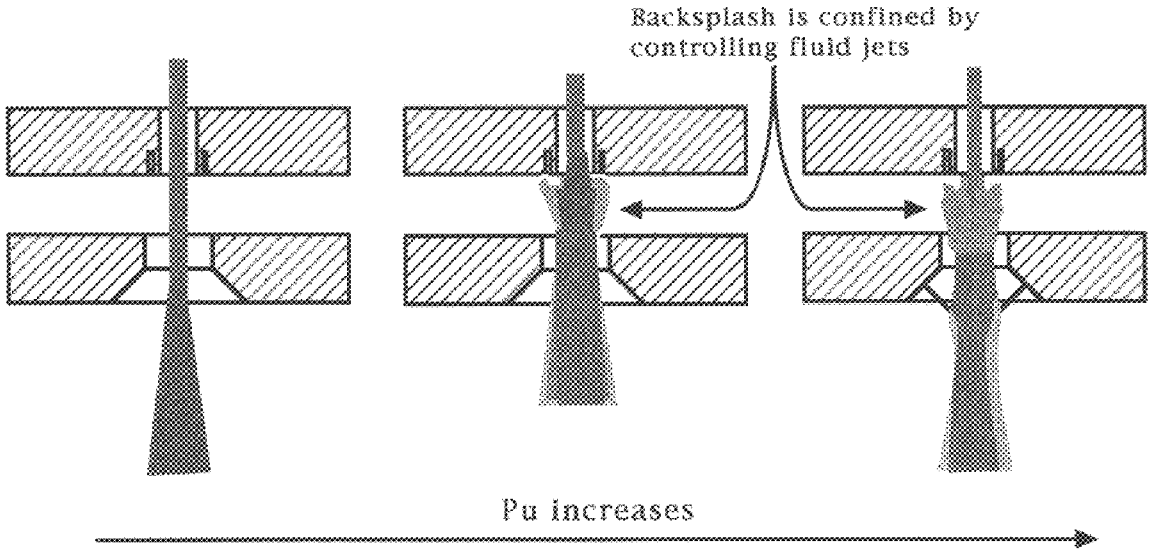
FIG. 7 shows the atomization phenomena for region B in the Process Map of Pu vs. $p_1$
Figure 8:
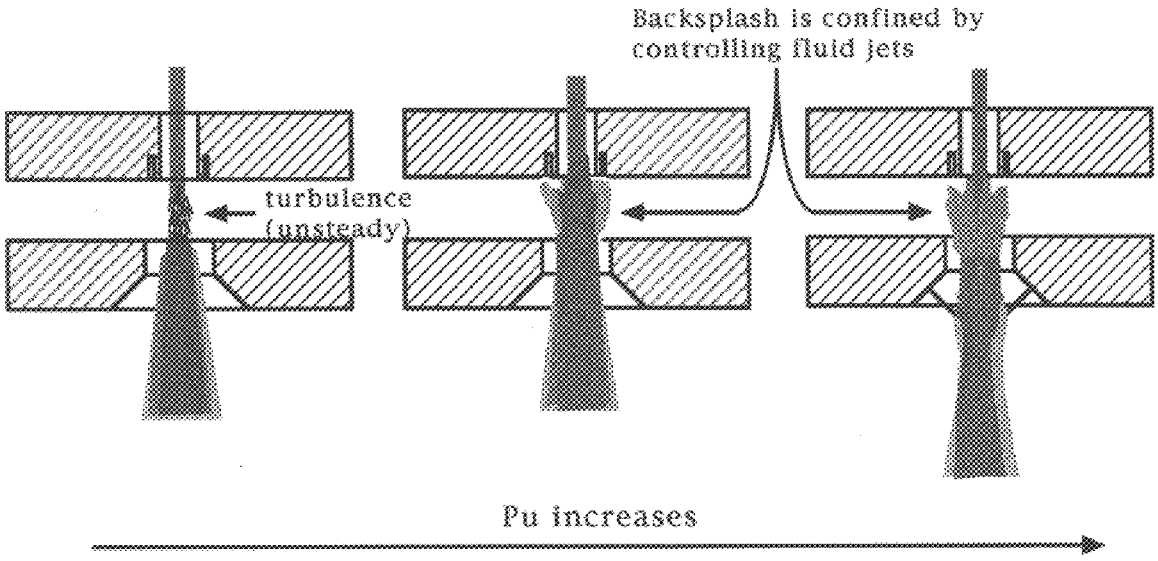
FIG. 8 shows the atomization phenomena for region C in the Process Map of Pu vs. $p_1$
Figure 9:
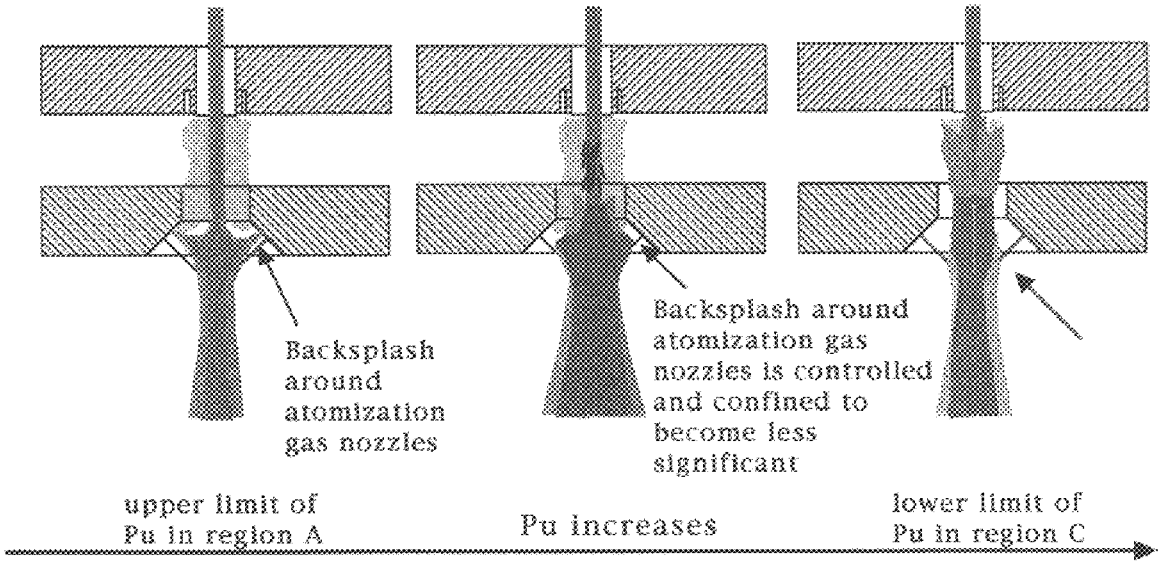
FIG. 9 shows the atomization phenomena for region D in the Process Map of Pu vs. $p_1$

The principles of selection of Pu and $p_1$ is discussed below for this example. FIGS. 3, 4, and 5 show the Process Maps of Pu vs. $P_1$ for R=15, 20, and 25 mm, respectively. In the figures, each map is divided into Regions A, B, C, and D. The effects of the controlling fluid jets device on the atomization characteristics of water for each Region are shown schematically in FIGS. 6 to 9, separately. In Region A, the controlling fluid jets are not able to surpress the backpressure completely. In Regions B and C, the backpressure is surpressed by the controlling fluid jets device; however, the water stream between the controlling fluid jets device and gas atomization device in Region C is more turbulent than that in Region B. Region D is the transition region between Region A and Regions B or C. In summary, Regions B and C are the regions suitable for water atomization in this example.

EXAMPLE OF THE USE OF NITROGEN GAS AS THE CONTROLLING FLUID IN THE PRODUCTION OF Pb-Sn POWDERS

The example below illustrates the conditions used for the production of Pb-50 wt % Sn powders. Table 1 lists the process parameters used for the production of powders. Pu is the nitrogen gas pressure used for the controlling fluid jets device, $p_1$ is the nitrogen gas pressure used for the gas atomization device, and R is the vertical distance between the controlling fluid jets device and gas atomization device.

Table 2 lists the first and second peak values of the distribution of powder sizes. For the condition of Pu=0, $P_1$=0.30 MPa and R=20 mm, the backsplash created due to the backpressure was so severed that nearly no atomization took place, which resulted in no powder being produced. However, when the controlling fluid jets device was switched on and Pu was set to be 0.20 MPa, the backpressure was so controlled that backsplash was eliminated and the powder was produced as illustrated by the A038 production. Using controlling fluid to control the backpressure is demonstrated.

Figure 10:
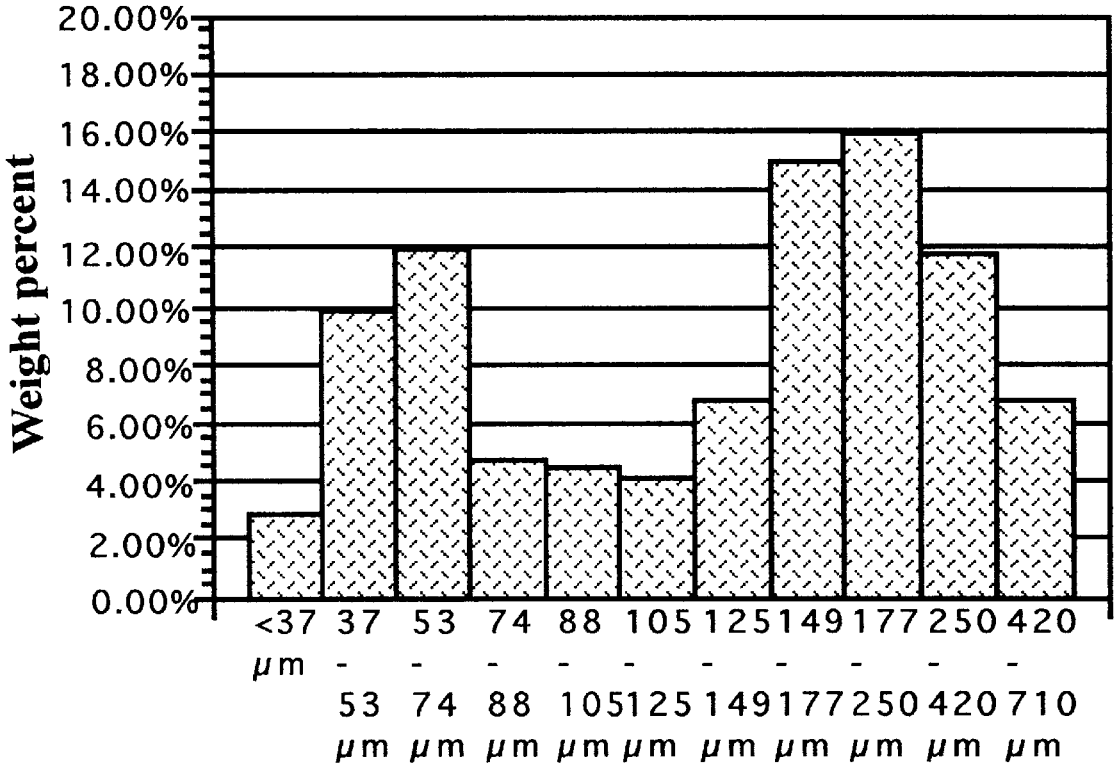
FIG. 10 shows the distributions of the powder sizes for each set of process parameters with the application of controlling fluid technique.
Figure 11:
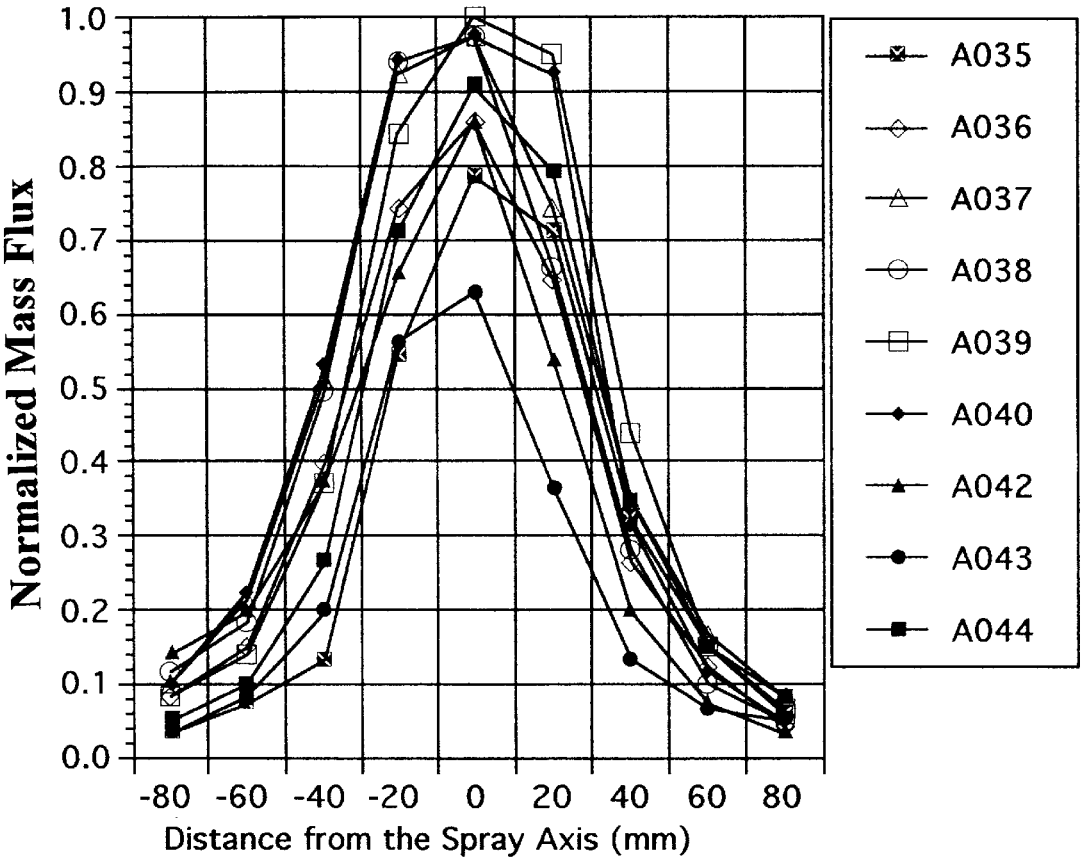
FIG. 11 shows the mass distribution of powders produced with the application of controlling fluid technique.

FIG. 10 shows the distributions of the powder sizes for each set of process parameters. It is shown that the first and second peak values of the distribution of powder sizes are controllable by varying the pressure and position of the controlling fluid jets. FIG. 11 shows the mass distribution of powders are controllable by varying the pressure and position of the controlling fluid jets. Using controlling fluid to control the atomization characteristics is demonstrated.

Figure 12:
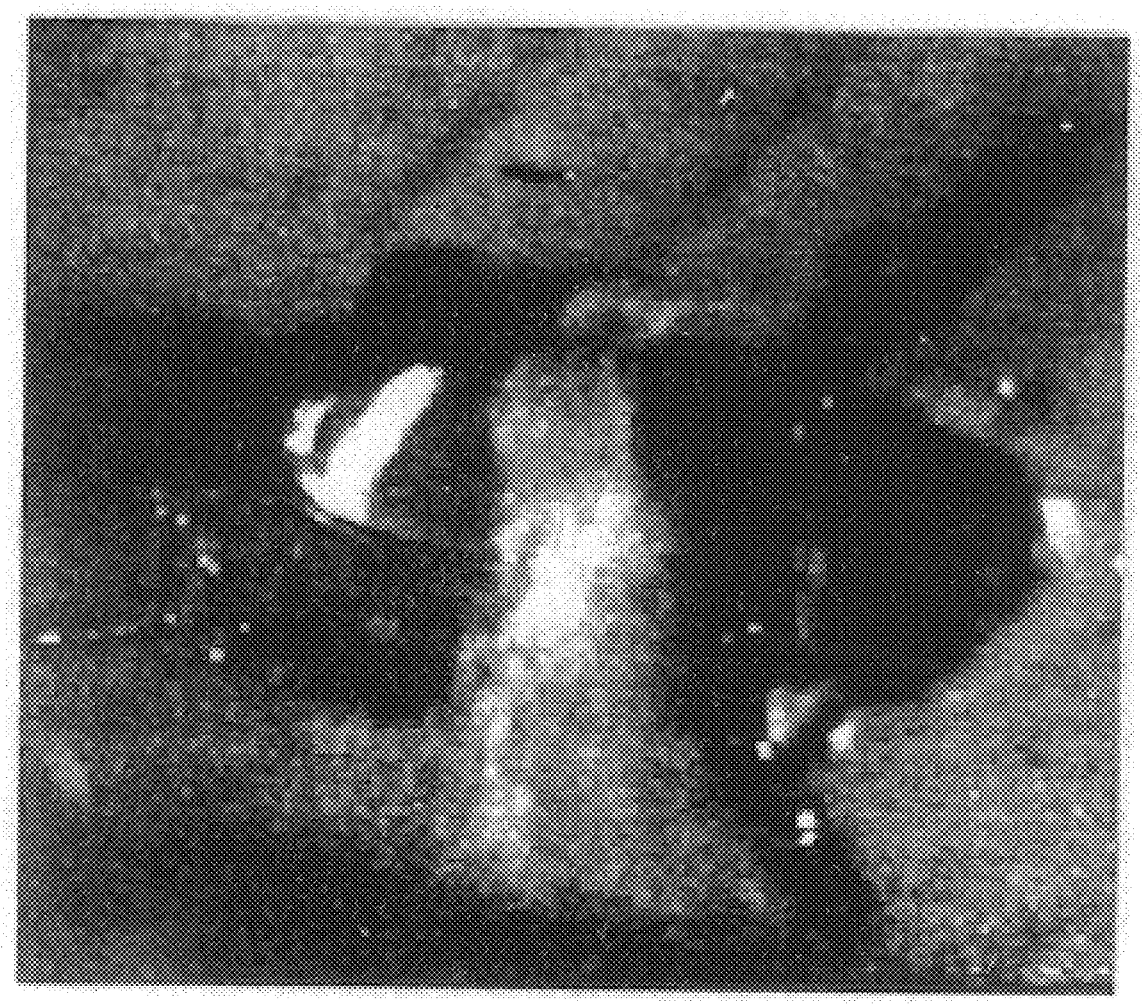
FIG. 12 shows the variations of the intensities and directions of the atomization gas jets as the pressure of the controlling fluid varies.
Figure 12:
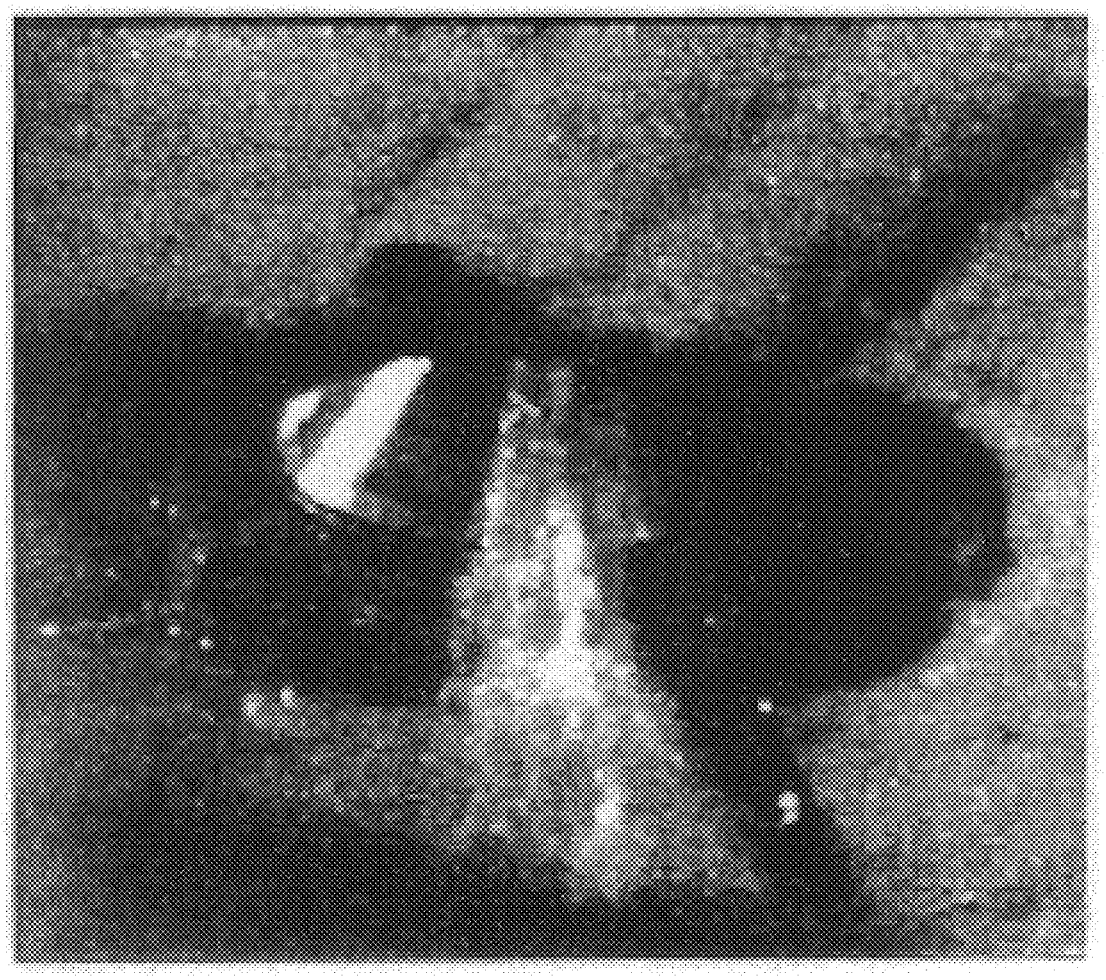
Figure 12:
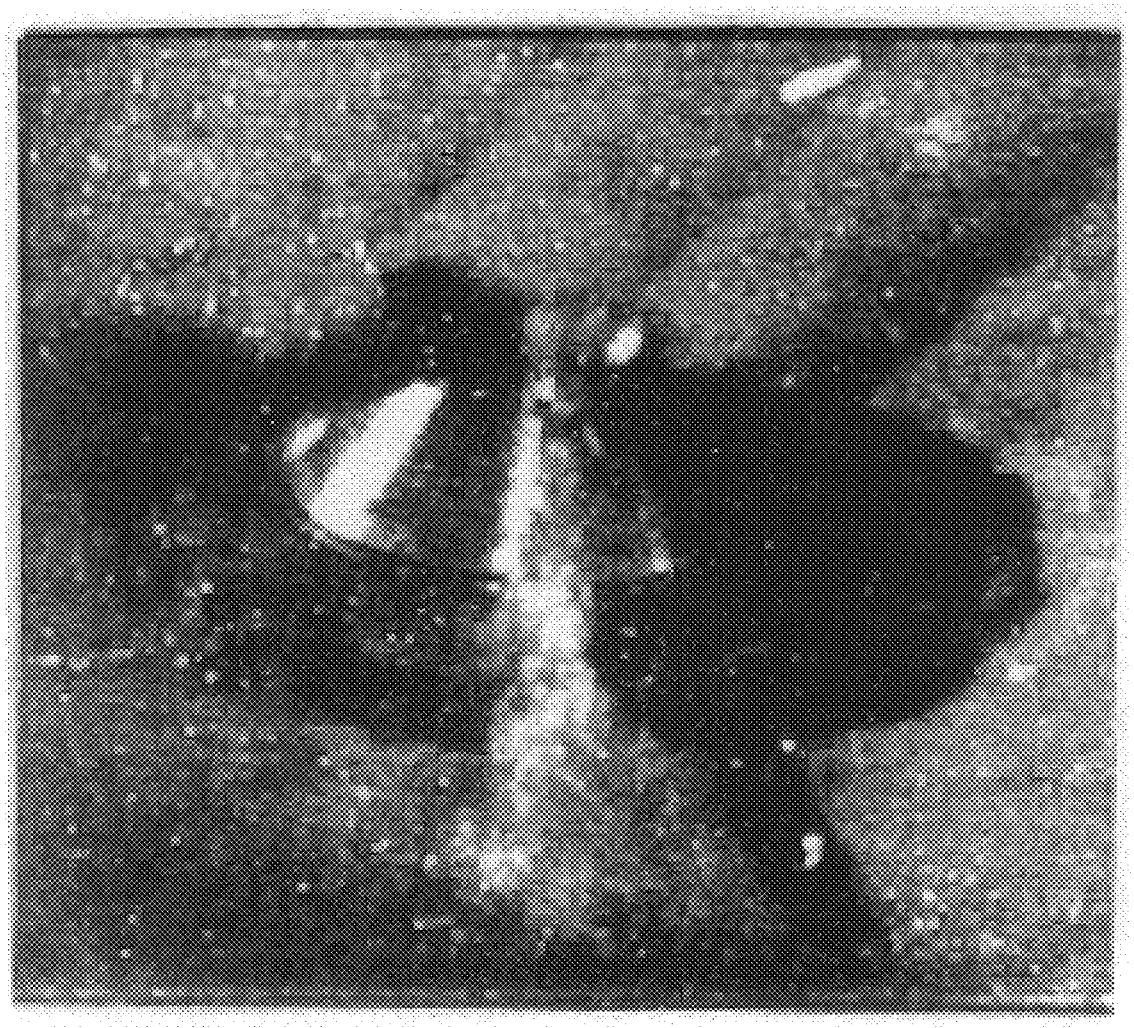
Figure 12:
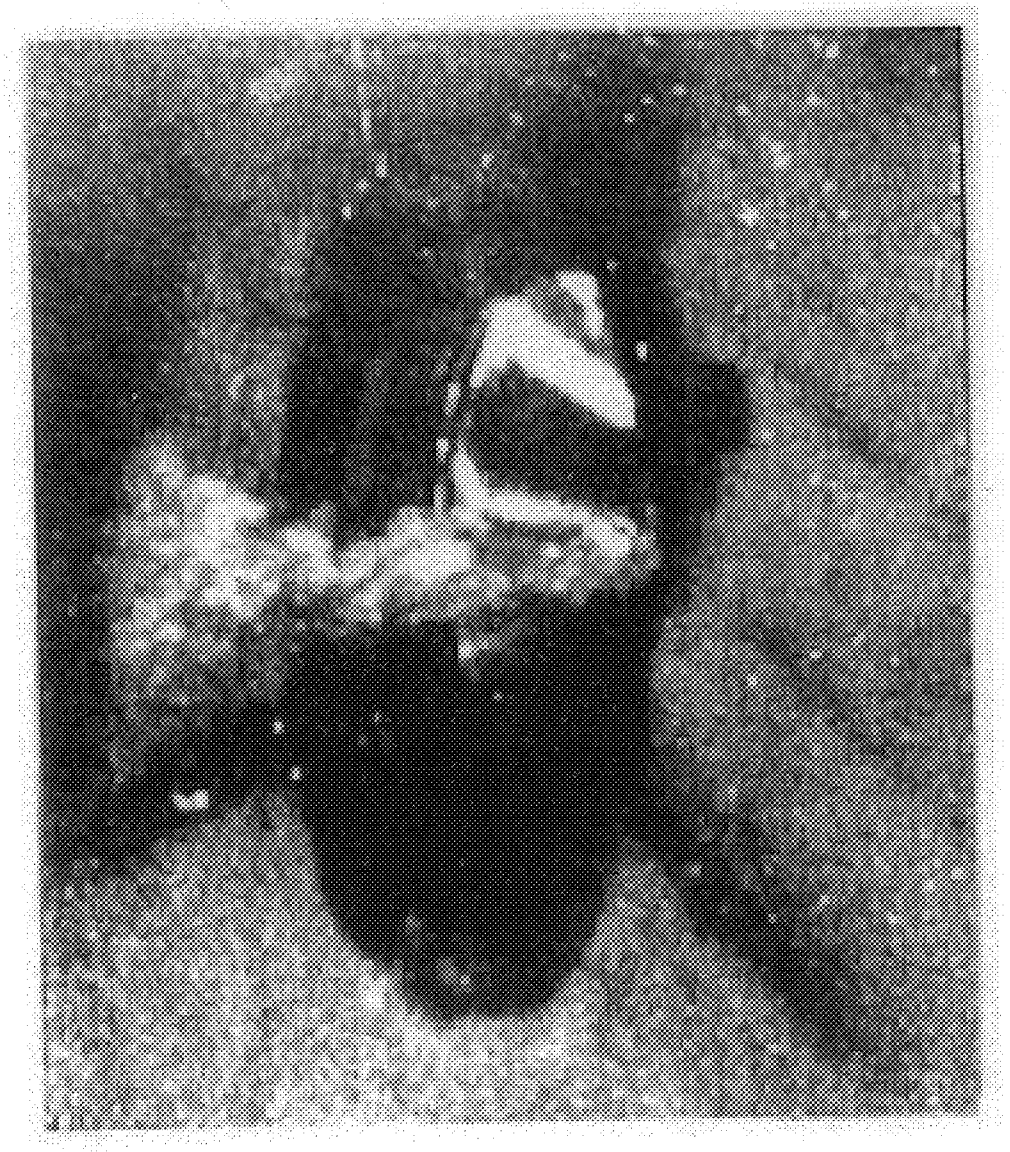
Figure 12:
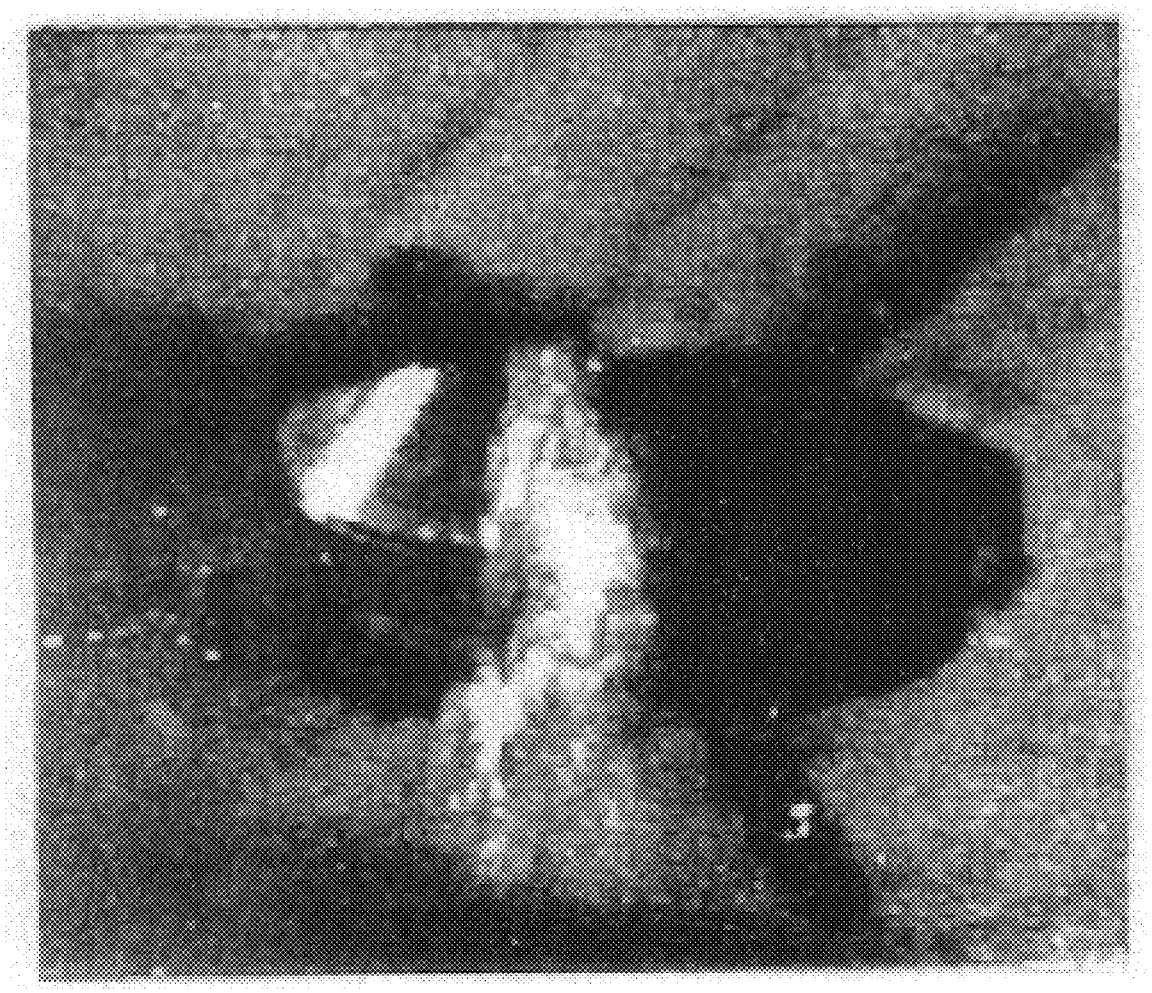
Figure 12:
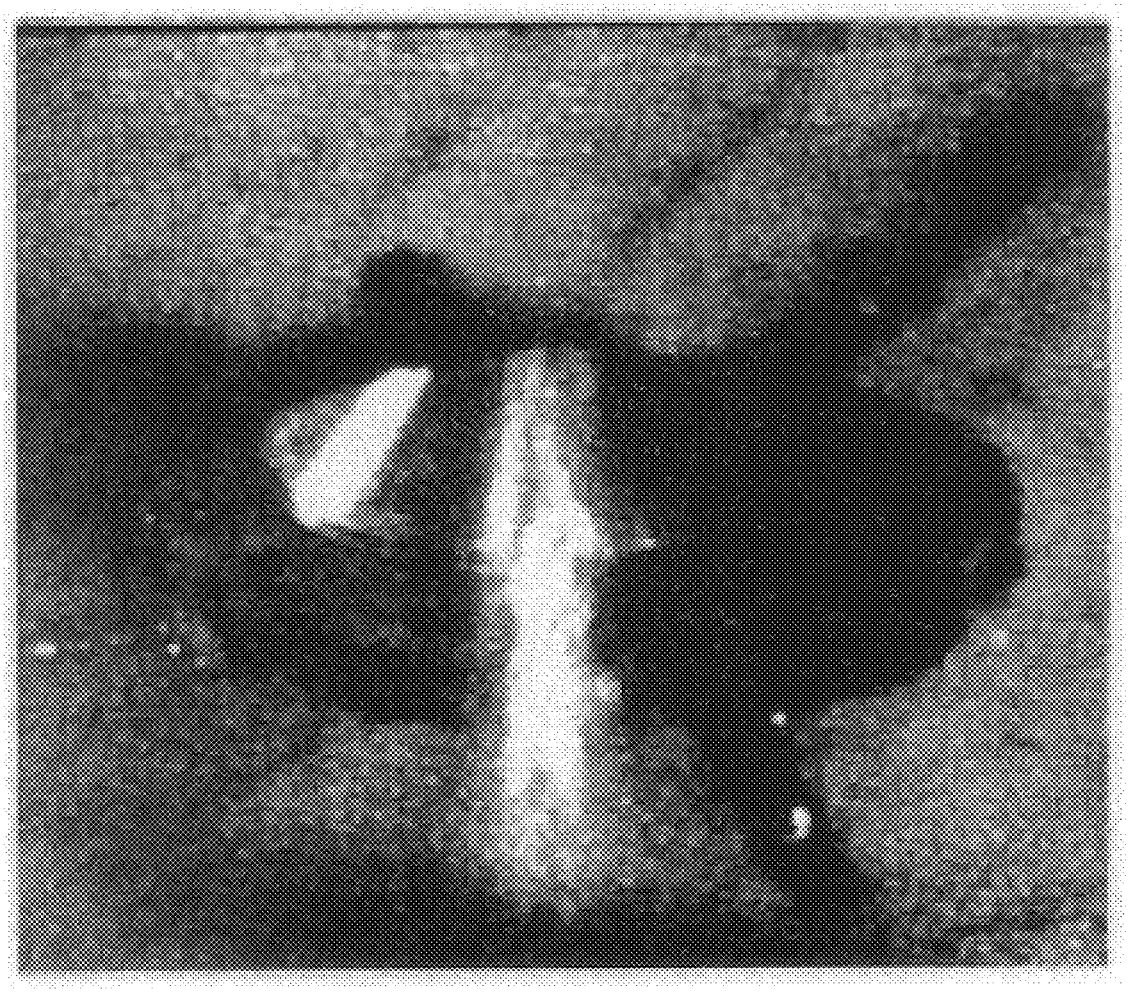
Figure 12:
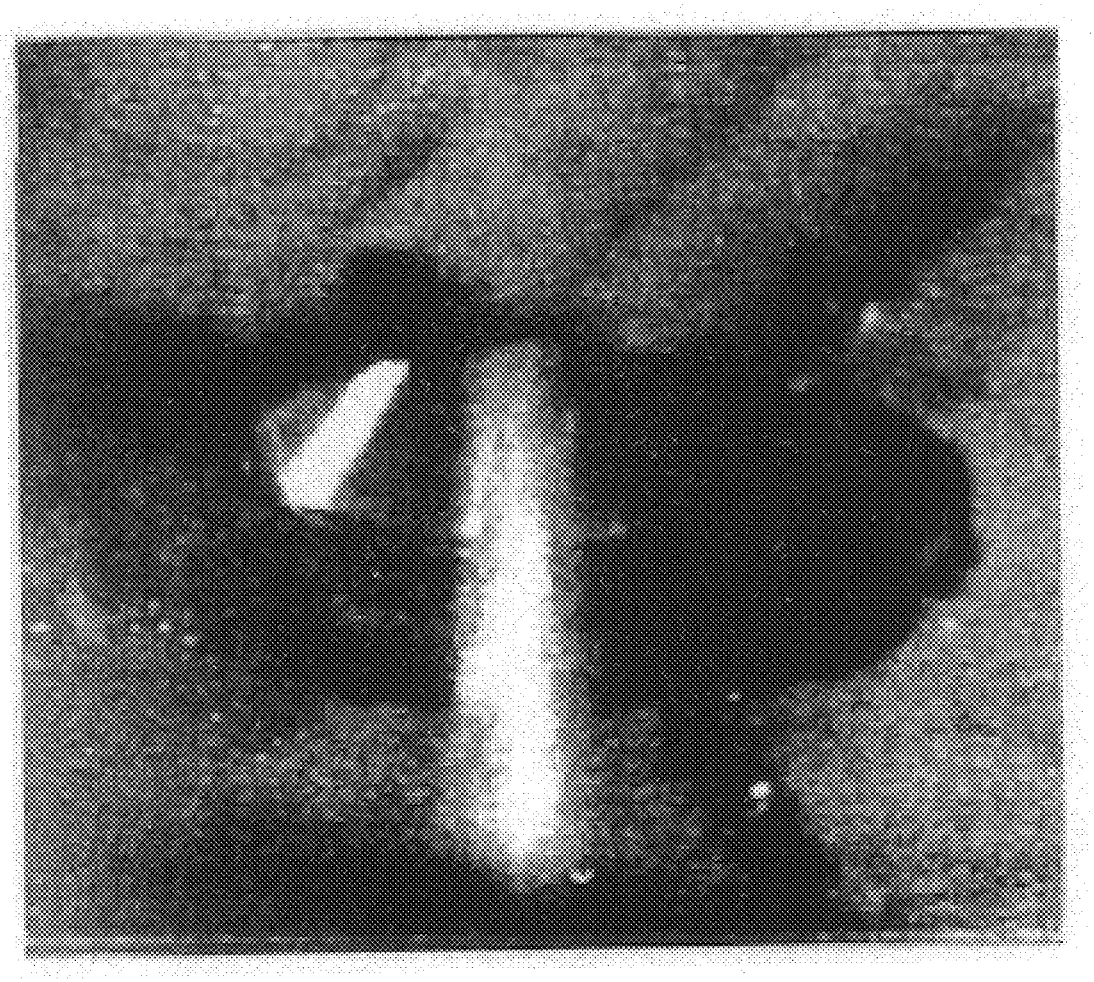

FIG. 12 shows the variations of the intensities and directions of the atomization gas jets as Pu varies. It is shown that the intensity of the atomization gas jets for Pu=0.14 MPa is relatively small compared to that for Pu=0.40 MPa, which gives a more scattered spray for the former. In addition, the direction of the atomization gas jets for Pu=0.14 MPa is also different from that for Pu=0.40 MPa, and the former has a larger included angle for the spray cone. Using controlling fluid to control the intensities and directions of the atomization gas jets is demonstrated.

A further application of the use of controlling fluid is in the production of spray deposits. In the production of spray deposits, liquid metal or metal alloy is atomized into a spray of droplets, which consists of a mixture of fully liquid, semi-solid/semi-liquid and solid particles. The resulting spray of metal droplets is directed onto an appropriate collector, where a preform is continuously deposited by these droplets. The process is essentially a rapid solidification technique with an integrated gas-atomizing/spray depositing operation. Deposits with different morphologies, such as tubes, billets, flat products, coated articles, etc., can be produced by manipulating the movement and shape of the collector, and by, in many situations, moving the spray itself. Such products can either be used directly or can be further processed normally by hot or cold working with or without the collector.

During atomizing, the backpressure is controlled by the controlling fluid jets device, which controls the extent of the backsplash and the atomization rate, or the flow rate of the metal or metal alloy stream coming out of the liquid delivery nozzle. In addition, the intensities and directions of the atomization gas jets are controlled by the controlling fluid jets device, which controls the atomization characteristics. Consequently, the droplet characteristics, such as the variations of size, shape, temperature, heat content and microstructure of droplets, etc., and spray-deposit characteristics, such as the morphology, macrostructures and microstructures of the deposit, etc., are controlled. The pressure and/or flow rate of the controlling fluid are in-situ adjustable during atomizing to in-situ control the backpressure and/or the intensities and directions of the atomization gas jets. Alternatively, the secondary controlling fluid jets may be so arranged, through which solid particles or whiskers of the same or different composition (either metallic or non-metallic) of the metal to be atomized are introduced into the controlling fluid which acts as a transport vehicle for the particles or whiskers to be co-deposited with the atomized droplets to form spray-deposited composite materials. Alternatively, the particles or whiskers are introduced from above the controlling fluid jets, which also gives a mixture of the particles or whiskers with the spray to form spray-deposited composite materials.

EXAMPLE OF THE USE OF NITROGEN GAS AS THE CONTROLLING FLUID IN THE PRODUCTION OF SPRAY-DEPOSITED PB-50% SN ALLOY PREFORMS

The example below illustrates the conditions used for the production of Pb-50% Sn spray-deposited preforms. Table 3 lists the atomization process parameters used to produce Pb-50% Sn powder employing the controlling fluid technique. In Example A, only atomization gas was used in the conventional manner of production of spray-deposited preforms. However, since the backsplash created due to the backpressure was so severe that nearly no atomization took place, which resulted in no preform being produced. In Example B, controlling fluid of Nitrogen was introduced by the controlling fluid jets device above the main atomization gas jets. Otherwise, the atomizing was carried out under identical conditions to Example A. The backpressure was so controlled by the controlling fluid jets device that backsplash was eliminated and a spray-deposited preform was produced. Using controlling fluid to control the backpressure in the spray deposition process was demonstrated.

TABLE 1

| Experimental No. | $P_I$ (MPa) | Pu (MPa) | R (mm) |
|---|---|---|---|
| A035 | 0.40 | 0.20 | 25 |
| A036 | 0.30 | 0.30 | 25 |
| A037 | 0.20 | 0.20 | 15 |
| A038 | 0.30 | 0.20 | 20 |
| A039 | 0.20 | 0.30 | 20 |
| A040 | 0.40 | 0.40 | 20 |
| A042 | 0.30 | 0.40 | 15 |
| A043 | 0.40 | 0.30 | 15 |
| A044 | 0.20 | 0.40 | 25 |

TABLE 2

| Experimental No. | first peak | second peak | second peak/ first peak |
|---|---|---|---|
| A035 | 177–250 μm | 53–74 μm | 0.36 |
| A036 | 250–420 μm | 53–74 μm | 0.24 |
| A037 | 250–420 μm | 88–105 μm | 0.31 |
| A038 | 250–420 μm | 53–74 μm | 0.18 |
| A039 | 250–420 μm | 53–74 μm | 0.17 |
| A040 | 250–420 μm | 53–74 μm | 0.17 |
| A042 | 177–250 μm | 53–74 μm | 0.34 |
| A043 | 177–250 μm | 53–74 μm | 0.75 |
| A044 | 250–420 μm | 53–74 μm | 0.29 |

TABLE 3

| Process Parameter | Symbol | Example A | Example B |
|---|---|---|---|
| Metal Dispensing Temperature(° C.) | $T_{spray}$ | 266 | 266 |
| Metal Flow Rate(Kg/sec) | $J_{melt}$ | 0.18 | 0.18 |
| Atomization gas pressure(MPa) | $P_I$ | 0.30 | 0.30 |
| Controlling fluid pressure(MPa) | Pu | 0.00 | 0.20 |
| Vertical distance between the controlling fluid jets device and gas atomization device(mm) | R | 20 | 20 |
| Spray Height(mm) | Z | 600 | 600 |
| Results | | Process Failed | Process Succeeded |

What claim is:

1. A method of atomizing a liquid stream of metal or metal alloy for the production of powders or spray deposits comprising the steps of:

teeming a stream of molten metal or metal alloy in an open environment into an atomization device including at least two atomization gas jets at an angle to said stream of molten metal or metal alloy, positioning at least two secondary jets at an angle to said stream and toward each other, aiming said secondary jets at said atomization gas jets or at an atomization zone located at an impinging point of said atomization gas jets, delivering atomization gas from said at least two atomization gas lets thereby impinging said atomization gas at said impinging point and generating a backpressure from said impinging step, atomizing the stream with atomization gas from said atomization gas jets to form droplets of metal or metal alloys, directing controlling fluid from said secondary jets at said atomization gas jets or at said atomization zone to control said backpressure, and controlling the intensities and directions of said atomization jets.

2. The method according to claim 1, wherein the pressure or flow rate of the controlling fluid are in-situ adjustable during atomizing to in-situ control the backpressure or the intensities and directions of the atomization gas jets.

3. The method according to claim 1, wherein the controlling fluid removes further heat from the metal or metal alloy stream or the atomized droplets.

4. The method according to claim 1 further comprising atomizing the metal or metal alloy stream to form droplets using the controlling fluid.

5. The method according to claim 1, wherein the controlling fluid is in a gaseous phase or in a mixture of gaseous phases.

6. The method according to claim 1, wherein the controlling fluid is cryogenic liquified gas which changes to a gaseous phase upon heating by the metal or metal alloy stream.

7. The method according to claim 1, wherein the step of directing controlling fluid controls at least one of a group consisting of: atomization efficiency, atomization rate, cooling rate of atomized droplets, trajectories and velocities of atomized droplets, shapes of atomized droplets, sizes of atomized droplets, and spatial flux distribution of atomized droplets.

* * * * *

UNITED STATES PATENT AND TRADEMARK OFFICE

CERTIFICATE OF CORRECTION

PATENT NO. : 5,993,509

DATED: November 30, 2000

INVENTOR(S): Chi-Yuan Albert Tsao, et al.

It is certified that error appears in the above-identified patent and that said Letters Patent is hereby corrected as shown below:

Assignee: National Science Council
Taipei, Taiwan, R.O.C.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*